US005197683A

United States Patent [19]

Cravero et al.

[11] Patent Number: 5,197,683

[45] Date of Patent: Mar. 30, 1993

[54] OIL MILL/CRUSHER

[76] Inventors: Michele Cravero, Strada Valentino-Fraz. Macellai, 12060 Pocapaglia; Emilio Gilardi, Via Martiri d'Italia 51, 10014 Caluso; Alberto Bertolo, Via Altinetti 3, 10040 Almese, all of Italy

[21] Appl. No.: 837,479

[22] Filed: Feb. 18, 1992

[30] Foreign Application Priority Data

Feb. 20, 1991 [IT] Italy ..... TO91A000117

[51] Int. Cl.[5] ..... B02C 13/282

[52] U.S. Cl. ..... 241/189.1; 241/242

[58] Field of Search ..... 241/189.1, 242

[56] References Cited

U.S. PATENT DOCUMENTS

| | | | |
|---|---|---|---|
| 2,595,810 | 5/1952 | Perry | 241/189.1 |
| 2,809,400 | 10/1957 | Maltenfort | 241/189.1 X |
| 3,630,458 | 12/1971 | Smiley | 241/189.1 X |
| 3,857,420 | 12/1974 | Ducasse | 241/189.1 |
| 4,151,959 | 5/1979 | Deister | 241/189.1 X |
| 4,231,529 | 11/1980 | Peck et al. | 241/189.1 |
| 4,907,750 | 3/1990 | Seifert | 241/189.1 X |

*Primary Examiner*—Mark Rosenbaum
*Assistant Examiner*—Frances Chin
*Attorney, Agent, or Firm*—Helfgott & Karas

[57] ABSTRACT

An oil mill/crusher includes an external casing having a cylindrical chamber, a rotor positioned in the chamber and eccentric with respect to the latter, a plurality of blades, constrained at one end to a central axial pin of the chamber and extended through the rotor in the chamber in grooves formed in rotating elements provided in the peripheral part of the rotor. The blades rotate around the pin. The eccentricity between the rotor and the chamber causes a continuous variation of a blade projection with respect to the peripheral part of the rotor operating the mill. The width of each of the blades is substantially equal to half the width of the width of the chamber. The blades alternatively rest on the right and left sides of the chamber, in order to avoid their jamming against knurled walls thereof.

3 Claims, 2 Drawing Sheets

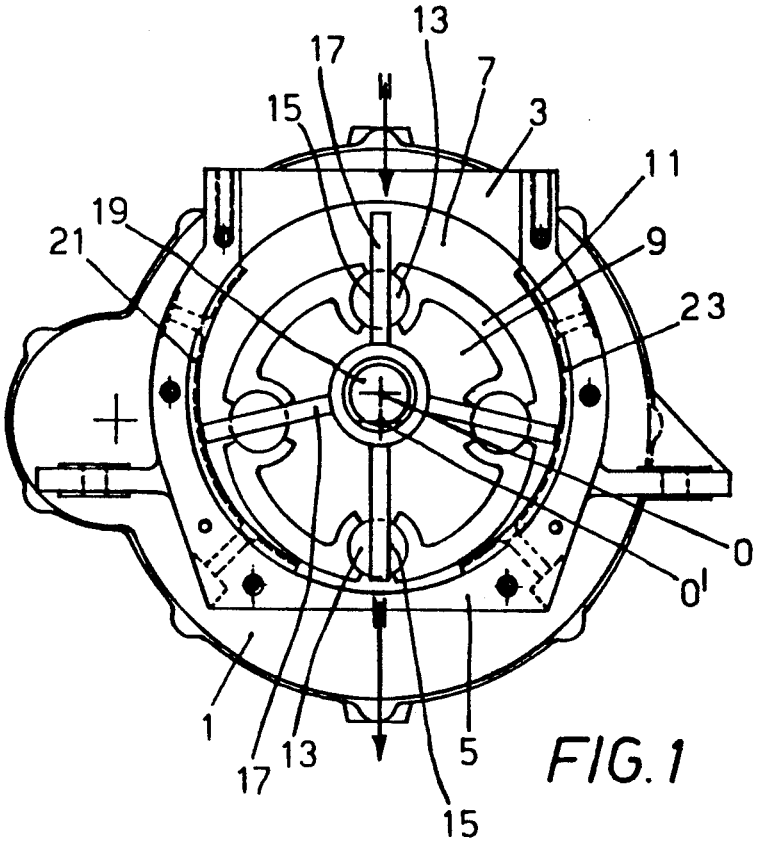
FIG. 1
FIG. 2
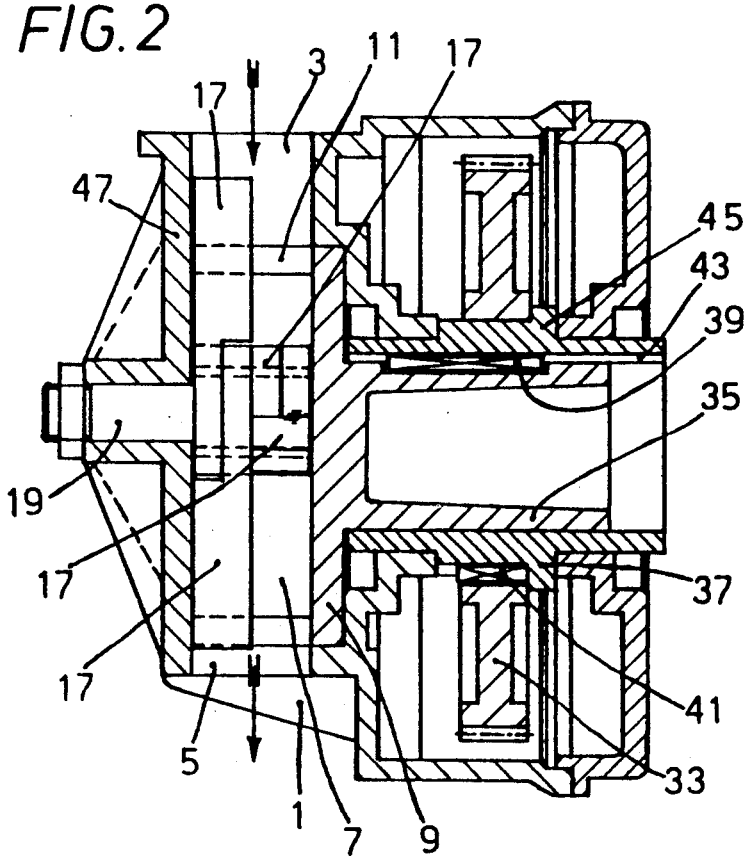

OIL MILL/CRUSHER

BACKGROUND OF THE INVENTION

1. Field of the Invention

The present invention refers to an improved oil mill or crusher.

2. Background of the Invention

It is known that, so far, in order to squash, crush and break olives and/or different seeds to produce oil and reduce to small fragments oat, barley, maize, broad bean, etc. grains to give them to animals and to compose fodder, different types of mills were and are nowadays used, such as cylinder or rolling mills, disc and muller ones.

Each one of these mills has its own specific properties regarding dimensions and functionalities, that are more or less important depending on the purpose to which it is aimed and depending on the user's choice criteria.

To solve the problems inherent to each one of these mills and to have a better yield, another type of a mill has been realized, in which blades, engaging the rotor with one degree of freedom, rotate and work inside a working chamber obtained in the mill envelope, generating the desired product.

This mill has been realized and invented by one of the applicants of the present patent application; reference is made to Italian Patent No. 1,128,003; dated Jan. 31, 1980.

This type of a mill has given rise, together with the evident advantages with respect to prior art mills, to some inconveniences, like frequent jammings of blades against the wall when the crushed product, frequently in grain form, is being unloaded outside; a low yield of the operating mechanism, realized with an helical worm screw; and difficulties related to the cleaning of the working chamber.

SUMMARY OF THE INVENTION

It is an object of the present invention to avoid the above mentioned inconveniences. This and other objects are attained by an improved mill in which no product jammings with the blades occur with the following machine block which has a motion transmission or a control device with a decisively higher efficiency, which can work the product with the desired degrees, in which at least two products can be worked instantaneously and which is constructed so that it can be easily disassembled to clean and wash the working structural components.

The improved mill of the present invention comprises:

an external envelope or casing, equipped with a load hopper and a product output hole and having a substantially cylindrical chamber;

a substantially cylindrical rotor placed inside the envelope with its rotation axis parallel to the axis of the envelope, but eccentrical to it in a substantially internally tangent position to the cylindrical;

a plurality of support means rotating on the rotor circumferential part, each having a radial slit suitable to slidingly house a blade;

a plurality of rotating blades hinged-constrained to an axial pin of the envelope at one of their ends and passing through the rotor peripheral or circumferential part due to the radial slit provided in the support means, said blades being substantially as long as the radius of the cylindrical chamber of the envelope;

two knurled arcs provided on the internal wall of the cylindrical chamber of the envelope and extending from the opening end of the load hopper to the output hole, said arcs composing with the internal rotor wall and the blades, a working chamber, wherein:

the blades are of a width that is substantially less than the width of the cylindrical chamber where they rotate and are provided alternatively, one adherent to the right side, the other one adherent to the left side of this chamber;

the number of said blades is at least three, and preferably four;

the support means rotating on the circumferential part of the rotor each have radial slit suitable to slidingly house one blade, and are also at least three, and preferably four;

the knurled arcs are provided, one with triangular grooves realizing a fine knurling, and the other one with triangular grooves realizing a coarse knurling; the direction of rotation of the rotor, and therefore the blades realizing a type of crushing, for example a fine crushing in one direction of rotation and a coarse crushing in the opposite direction;

rotation control means of the rotor are provided composed of a sprocket wheel and a wheel gear, the sprocket wheel being connected to a motor through a pulley, the gear wheel being connected to the rotor shank, integrally therewith and extending normal thereto through a coupling bush;

the bush connecting said shank with said gear wheel and being internally coupled through a key with said shank and externally coupled with the gear wheel through another key;

said coupling bush being internally cylindrical and equipped with a through-groove along one of its generatrixes and having support projections extending outwardly thereof towards the envelope, said projections, oriented along one direction, and said through-groove enabling, once having removed the mill cover and withdrawn the blades from the pin, a quick withdrawal of the rotor shank from the bush, thus allowing very quick cleaning and washing operations, that could not be obtained with the mill realized according to the previously mentioned patent.

According to a preferred embodiment of the invention, the mill has four blades housed in four rotating supports, two of which rest against the right side of the cylindrical chamber, the other two of which rest against the left side of said chamber; the width of each blade is substantially equal to half the width of the cylindrical chamber in which they rotate; the triangular grooves for the fine crushing are 90° -angled grooves, and the triangular grooves for the coarse crushing are 120° -angled grooves.

The preferred embodiment of the invention does not obviously constitute any limitation to the mill under consideration; depending on product properties and depending on certain users' needs, the number of blades can be greater than four, the knurling arcs can have grooves with particular angles, and the width of said blades can be greater than half of the cylindrical chamber width, but less than said width so as to allow the product being worked to be laterally unloaded when the blade passes and to prevent its jamming by foreign bodies or material particles that become jammed between the blades and knurled arc.

It is anyway always true that a blade, or a couple of blades, works resting against a side of the cylindrical crushing chamber, while the other blade, or couple of blades, works against the other side.

The invention will now be described in detail with particular reference to the enclosed drawings, given as a non limiting example, and showing a preferred embodiment of the invention.

BRIEF DESCRIPTION OF THE DRAWINGS

FIG. 1 is a front view of a mill according to the present invention;

FIG. 2 is an axial section of the mill of FIG. 1;

DESCRIPTION OF PREFERRED EMBODIMENTS

Figure 3:
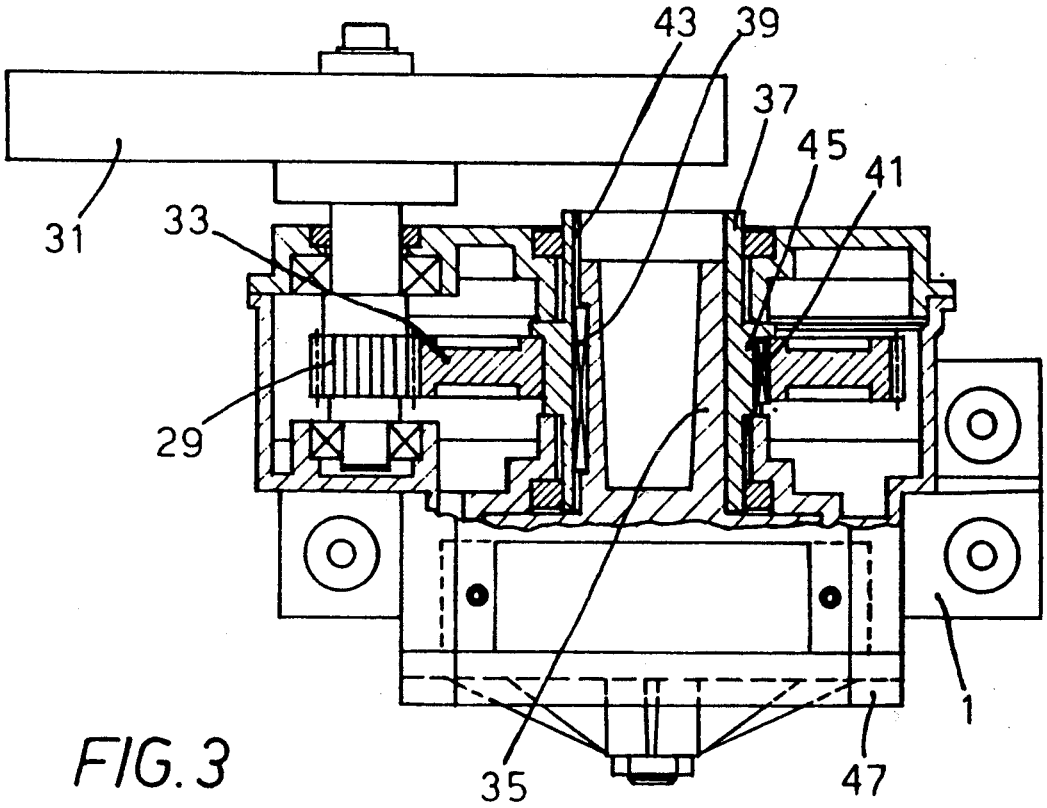
FIG. 3 is a section view of the mills showing the control elements.

With reference to the Figures, the mill under consideration is substantially composed of an external envelope 1 or casing, equipped with a load hopper 3 and an output hole 5 for the product, having a substantially cylindrical internal chamber 7.

A rotor 9, also substantially cylindrical, is placed inside the chamber 7 with its rotation axis 0' parallel to the axis 0 of the chamber 7 but eccentrically moved with respect to it, in a substantially internally tangent position to the chamber 7.

On the circumferential part or edge 11 of the rotor 9, a plurality of constrained supports or elements 13 are provided, placed rotating on the circumferential part 11, and each of them having a radial slit 15, suitable to slidingly house a respective blade 17.

Each one of these blades 17 is part of a plurality of blades 17, provided inside the chamber 7, housed in the contrained elements 13 of the rotor 9, hinged-constrained to an axial pin 19, central at the chamber 7, to one of their ends and passing through the peripheral part or edge 11 of the rotor 9 due to the above mentioned radial slits 15 provided in the rotating constrained elements 13.

The blades 17 have a length that is substantially equal to the radius of the cylindrical chamber 7 of the envelope 1.

On the internal wall of the cylindrical chamber 7 and running from the opening end of the load hopper 3 towards the output hole 5, two knurled shells or arcs 21, 23 are provided these arcs form, with the external wall of the rotor 9 and with the blades 17, the working chamber in which the mill operates.

The blades 17 are of a width that is substantially less than that of the chamber 7 where they rotate and are alternatively assembled, one adherent to the right side, the other one adherent to the left side of chamber 7.

In the described embodiment, the number of blades 17 is four, because four rotating constrained elements 13 are provided in circumferential part 11 of the rotor 9. The width of equal to half of that of the chamber 7.

Figure 4:
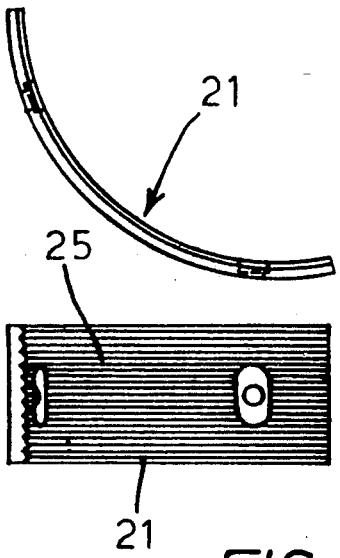
FIG. 4 is a front side view of the knurled shell for fine crushing.
Figure 5:
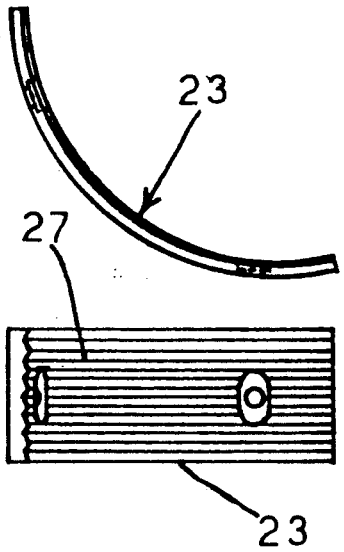
FIG. 5 is a front side view of the knurled shell for coarse crushing.

The knurled arcs 21 and 23 provided on the internal wall of the cylindrical chamber 7 of the envelope 1 are formed with grooves as shown in FIGS. 4 and 5. knurled arc 21 has triangular grooves 25 having an angle 90°, realizing a fine knurling, and the knurled arc 23, has triangular grooves 27 having an angle 120° realizing a coarse knurling.

The rotation of the rotor 9 and therefore of the blades 17 in one direction generates one type of crushing, for example a fine one, while the rotation of the blades 17 in the other direction generates the other type of crushing, for example a coarse one.

The mill control device includes a wheel gear coupling comprised of a sprocket wheel 29 and a gear wheel 33. Wheel 29 is connected to a pulley 31 driven by an adequate motor (not shown), the gear wheel 33 being connected to a shank 35 integral with and normal projecting to the rotor 9 through a bush 37.

The bush 37 connecting shank 35 to gear wheel 33 is internally coupled through a key 39 with said shank and externally coupled with the gear wheel 33 through another key 41.

The bush 37 has an internal cylindrical surface and is formed with an axial through-groove 43 along one of its generatrixes. The bush 37 is further provided on the external surface thereof with support projections 45 extending towards the casing 1. Projections 45 oriented in one direction and through-groove 43 enable once the mill cover 47 has been removed and the blades 17 have been withdrawn from the pin 19, a quick withdrawal of the shank 35 and therefore of the rotor 9 from the bush 37, thus allowing very quick cleaning and washing operations, which cannot be obtained with the mills according to the prior art and in particular with the mill that is the object of the previously mentioned Italian Patent.

According to the above described preferred embodiment of the invention, the mill has four blades 17, housed in four rotating supports 13; two of them rest against the right side of the cylindrical chamber 7, the other two of them rest against the left side of chamber 7; the width of each blade 17 is substantially equal to half width of the cylindrical chamber 7 where they rotate; the triangular grooves 25 for fine crushing are angled 90°, whereas triangular grooves 27 for coarse crushing are angled at 120°.

This preferred embodiment of the invention does not obviously constitute any limitation to the mill under consideration; depending on product properties and depending on certain users' needs, the number of blades 17 can be greater than four. In some cases the number of blades 17 can be equal to three. The knurled shells 21, 23 can have grooves with particular angles, different from 90° and 120°, and the width of blades 17 can be greater than half the width of the cylindrical chamber 7, but less than said width such as to allow the product being worked to be laterally unloaded when the blade passes and to prevent its jamming by foreign bodies or material particles that become jammed between blades 17 and knurled shells 21, 23.

We claim:

1. An oil mill/crusher comprising:

an external casing having an axis and including a load hopper, an axial pin, a product output opening, and a substantially cylindrical chamber, said chamber having an internal wall;

a substantially cylindrical rotor positioned inside the casing and having an axis of rotation parallel to the axis of the casing so that the rotor is eccentrical to the axis of the casing and is in a substantially internally tangent position to said chamber, said rotor including a circumferential part having an external wall and a shank;

a plurality of rotating blades;

a plurality of constrained support means rotating on the circumferential part of the rotor and each having a radial slit to slidingly house a respective blade;

said plurality of blades being hinged-constrained to the axial pin of the casing at one end thereof and passing through said circumferential part due to radial slits provided in said constrained support means, said blades being substantially as long as a radius of the cylindrical chamber of the casing;

two knurled arcs provided on the internal wall of the cylindrical chamber of the casing and extending from an opening end of the load hopper to the product output opening, said arcs forming with said external wall and the blades, a working chamber of the mill/crusher;

the blades being of a width which is substantially less than a width of the cylindrical chamber where they rotate, the blades being alternatively assembled, one adherent to a right side, the other one adherent to a left side of said chamber;

said blades being at least three in number;

the constrained support means being at least three in number;

said two knurled arcs being provided with triangular grooves, one of the knurled arcs having triangular grooves for a fine crushing and another of said arcs having triangular grooves for a coarse crushing;

rotation control means for the rotor, said rotation control means including a motor, a wheel gear coupling comprised of a sprocket wheel and a wheel gear coupled to the sprocket wheel, a coupling bush, the sprocket wheel being connected to said motor through a pulley, the wheel gear being integrally connected to said shank of the rotor and extending normally thereto on said coupling bush;

said coupling bush connecting said shank with said wheel gear and being internally coupled through a key with said shank and externally coupled with the wheel gear through another key; and a removable cover;

said coupling bush having a through-groove extending along a generatrix thereof and having support projections extending outwardly thereof toward the casing, said projections and said through-groove enabling, once said cover has been removed from the casing and the blades have been withdrawn from the axial pin, a quick withdrawal of the shank from the bush, thus allowing quick cleaning and washing operations.

2. An oil mill/crusher according to claim 1, wherein said blades are four in number and housed in four rotating constrained support means, respectively, two of said blades resting against the right side of the cylindrical chamber and other two blades resting against the left side of said cylindrical chamber, wherein the width of each of said blades is substantially equal to half the width of the cylindrical chamber, and wherein the triangular grooves for the fine crushing are angled at 90° , and the triangular grooves for the coarse crushing are angled at 120°.

3. An oil mill/crusher according to claim 1, wherein, on properties of a product to be processed and depending on needs of a user, and wherein the width of each of said blades is greater than half the width of the cylindrical chamber but less than the total width of the cylindrical chamber so as to allow a product being processed to be laterally unloaded when the blades rotate and to prevent jamming of the blades by foreign bodies and material particles that become jammed between the blades and the knurled arcs.

* * * * *